United States Patent [19]

Baud et al.

[11] Patent Number: 5,028,035

[45] Date of Patent: Jul. 2, 1991

[54] APPARATUS FOR GAS TREATMENT OF A LIQUID ALUMINUM BATH

[75] Inventors: Olivier Baud, Issoire; Franck Boeuf, Ottikon, both of France

[73] Assignee: Pechiney Rhenalu, Courbevoie, France

[21] Appl. No.: 551,905

[22] Filed: Jul. 13, 1990

[30] Foreign Application Priority Data

Sep. 20, 1989 [FR] France ..... 89 12540

[51] Int. Cl.[5] ..... C21B 7/16

[52] U.S. Cl. ..... 266/217; 266/265

[58] Field of Search ..... 266/217, 265, 233

[56] References Cited

U.S. PATENT DOCUMENTS

| | | | |
|---|---|---|---|
| 3,703,340 | 11/1972 | Salmon et al. | 266/233 |
| 4,203,581 | 5/1980 | Pelton | 266/217 |
| 4,327,901 | 5/1982 | Kaiser | 266/217 |
| 4,607,825 | 8/1986 | Briolle et al. | 266/217 |
| 4,884,786 | 12/1989 | Gillespie | 266/233 |

*Primary Examiner*—S. Kastler

*Attorney, Agent, or Firm*—Dennison, Meserole, Pollack & Scheiner

[57] ABSTRACT

An apparatus for gas treatment for a bath of liquid aluminum at rest in a furnace having a roof and in which the bath has a surface area of at least 10 m$^2$. The apparatus comprises a movable gantry placed over the furnace and from which are suspended at least three gas injector assemblies which are more than 2 m long each. The injector assemblies are partially immersed in the bath through openings in the roof of the furnace and the immersed parts are separated from each other solely by the bath. The assemblies each comprise a rotary shaft having a rotor at its lower end joined to a plurality of blades. Through the axis of the shaft there is a cavity which opens above the furnace and which communicates at its lower end with passages in the blades. Means are provided above the furnace for rotating the shafts and for connecting the cavities to a source of treating gas. Each shaft is enclosed by a stator which extends from a point above the roof downwardly to a point close to the upper surface of the rotor to provide a space between the rotor and the stator which is adapted to be filled with the bath and to serve as a shock absorber.

11 Claims, 2 Drawing Sheets

APPARATUS FOR GAS TREATMENT OF A LIQUID ALUMINUM BATH

Figure 1:
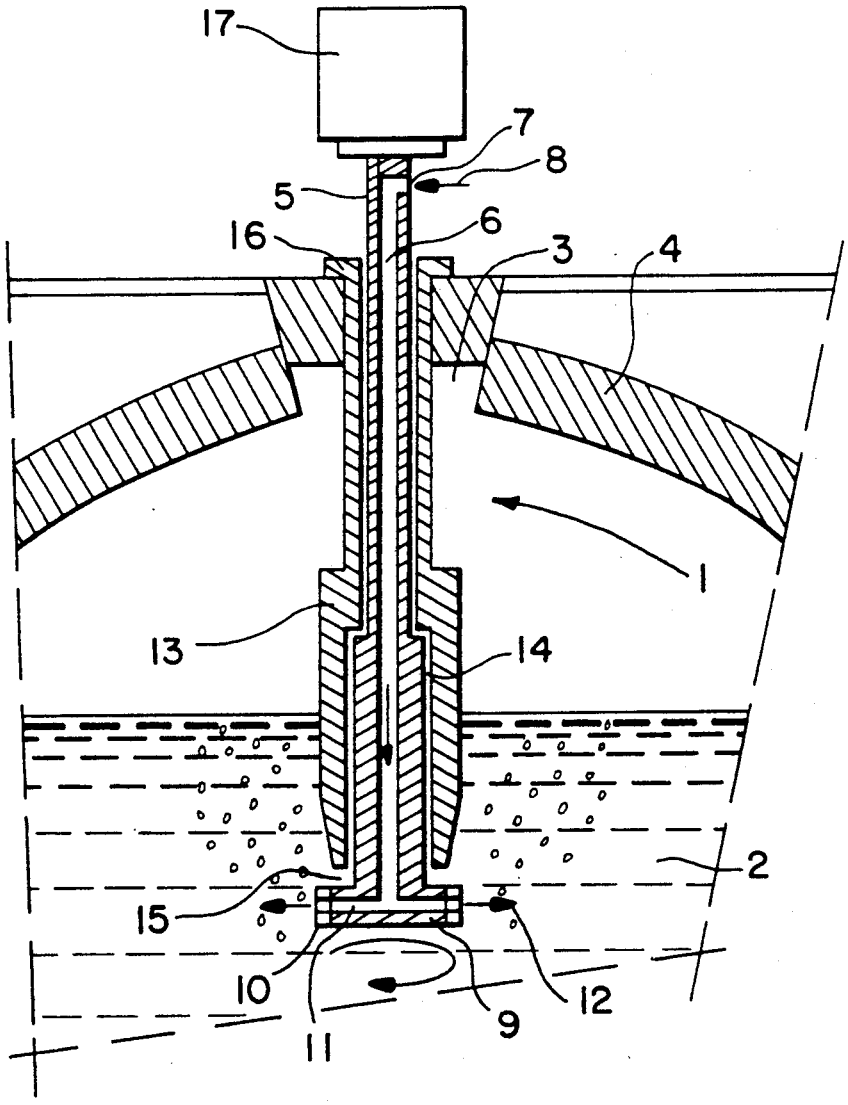

The present invention relates to an apparatus for treating by means of gas a bath of liquid aluminium of large surface area which is maintained in a stationary condition in a furnace.

Here, the term "aluminium" refers both to aluminium containing conventional impurities at levels which are a function of the quality treated, and the various alloys which this element is capable of forming. Likewise, the word gas relates both to simple elements such as nitrogen, argon and chlorine, for example, and to their mixtures.

A man skilled in the art of aluminium smelting knows that the metal which he uses contains impurities. These impurities consist mainly of hydrogen and metallic oxides such as alumina which emanate above all from pollution of the metal by the mositure in the environment, to which may be added other substances and in particular other metals such as magnesium, for example, when the aluminium originates from the remelting of waste. These impurities either form inclusions and cause faults in the cast products or they impart undesired mechanical properties to them. It is therefore vital to treat the aluminium in order to remove these impurities before casting it.

Generally, this treatment consists in introducing into the bath of liquid metal, possibly in the presence of flux, one or a plurality of reactive and/or inert gases, the purpose of the former being to react with certain impurities such as magnesium, for example, the latter entraining the impurities initially present or formed during the course of reactions, towards the surface of the bath where they may be separated by skimming and filtration. This treatment may be carried out in furnaces, whether they be furnaces for processing alloys, holding furnaces where the metal is in a stationary state and/or in crucibles in which the metal flows continuously to the casting stations.

The intended aim of this treatment is obviously efficiency, that is to say it is desired to obtain the greatest purification in the shortest time with the smallest possible quantity of gas. This last parameter is particularly important if a gas such as chlorine is being used for treatment. Indeed, it is well known that this gas is an element which is toxic to man and which, furthermore, has corrosive properties in respect of in general use metals such as iron, copper, etc. Therefore, if a fraction of the volume of chlorine introduced does not react with the bath, then indeed the efficiency of the treatment will be reduced but it will have nasty consequences with regard to the safety of the personnel and pollution of the environment. Hence the application of techniques which make it possible to obtain greater or lesser efficiency.

These techniques may be classified in two groups:

techniques by injection in a furnace such as the introduction of gasifiable chlorinated compounds such as hexachloroethane or gas from fixed injectors such as porous plugs, lances or rods. In this case, it is only a function of injecting gas into the bath which is performed;

"in-line" crucible injection techniques in which rotating assemblies are used which fulfil both the functions of injecting gas into the bath and of blending the bath.

The conventional laws of chemical engineering show that the efficiency of a treatment by injecting gas into a liquid metal depends first and foremost:

on a physico-chemical type of liquid metal/gas exchange coefficient;

on the specific surface area of the bubbles which, in the case of bubbles which are assumed to be spherical, is inversely proportional to their diameter;

on the volumetric fraction of gas, that is to say the quotient of the division of the total volume occupied by the bubbles by the total volume of the metal.

For a constant flow of gas, the greater the agitation and the smaller and more disperse are the bubbles, the larger will be the interface between the gas and the liquid metal and the greater will be the efficiency of the system. This is the principle of rotary injectors which combine with the injection a considerable effect of agitation in the volume of bath treated. However, when the rate of gas flow is increased in the presence of a given agitation, the volumetric fraction of gas increases because, above a certain level of gas flow, agitation is no longer sufficiently effective in dispersing the bubbles which coalesce: their diameter increases then considerably and the efficiency of the treatment diminishes rapidly. This is a fortiori true when there is an injection of gas with no concomitant agitation as is the case with conventional apparatuses such as hexachloroethane and injection lances, rods or porous plugs.

That is why, when it is desired to achieve maximum efficiency, it is preferable to use rotary injectors.

Furthermore, with the knowledge that the purity of the metal at the outlet from the crucibles is a function of the purity at intake, it is possible to conceive the importance of being able to provide the most efficient possible treatment means in the furnaces.

Well, with the present state of our knowledge, it is noted that if the rotary injectors are now mounted on the majority of in-line treatment crucibles, it is not so in the case of furnaces where hexachloroethane, porous plugs and rods are still prevalent. Why, then, are not rotary injectors used in the furnaces?

The Applicants, experienced both in the field of crucibles and in that of furnaces, explain this state of affairs as follows: on the one hand, the furnaces almost always have a bath volume and surface area ten times greater than those of crucibles and their height is likewise far greater. Furthermore, rotary injectors are generally of graphite, the only material capable of withstanding the abrasive action of the metal and the corrosive effect of the chlorine at temperatures close to 800° C. but the graphite is relatively fragile.

Under these conditions, it is difficult to imagine such rotary injectors being transposed to furnaces. Indeed, for them to act suitably in the whole of the bath, it would be necessary substantially to increase the diameter of the rotors and hence the considerable torque needed for them to rotate would means stresses which are incompatible with the mechanical strength of graphite.

Furthermore, by virtue of the relatively great distance separating the level of the bath from the roof of the furnace, it would be necessary to position the rotors on the ends of shafts more than 2 m long, which would inevitably produce a "whiplash" phenomenon, that is to say a tendency to depart from the vertical, a stress which the graphite cannot handle by reason of its low elasticity and which would end up in shaft breakage. Furthermore, the introduction of such an injector into a furnace would mean the provision of suitable apertures, an arrangement which it would be difficult to achieve and which would in any event be very expensive on existing furnaces.

Indeed, there have also been thoughts of using a number of rotary injectors of the type used in crucibles but for the problem of length, which would always crop up in addition to that of the contrary stresses which each might develop within one and the same bath volume and which would then be translated into an overall reduction in efficiency. This handicap, which is already apparent in relatively large volume crucibles, has been overcome by using intermediate partitions.

A crucible of such a type is described in U.S. Pat. No. 3,870,511. But such a solution cannot be envisaged in a furnace because it would mean tremendous difficulties in construction, operation and maintenance.

That is why the Applicants, aware of the increased efficiency which would be offered by systems in which injection and blending are carried out simultaneously, have in spite of all these obstacles sought to find a solution to the problem of installing these rotary injectors in a furnace without having recourse to any substantial modification.

They achieve this by conceiving of an apparatus employing gas to treat a bath (2) of liquid aluminium at rest in a furnace (28) in which it occupies a surface area at least equal to 10 sq.m and comprising a removable portico or gantry (21) situated over the furnace and from which there is suspended an assembly (1) for injecting gas and blending the bath which is partly immersed into the bath through an aperture (3) provided in the roof (4) of the furnace, the said assembly comprising a rotary shaft (5) drilled according to its axis through a cavity (6) which is closed at the bottom and which opens out above the furnace at (7), the said shaft being equipped in its upper part with a motor (17) and at its lower part with a rotor (9) provided with blades (10) in which there are passages (11) connected to the cavity, characterised in that there are suspended from the portico at least three assemblies more than 2 m long and with a vertical axis of symmetry which, taken two by two, are situated in different planes, of which the immersed parts are separated from one another solely by the bath, each of the shafts being enclosed by a stator (13) extending downwardly close to the upper surface of the rotor and upwardly to above the roof.

Thus, the apparatus according to the invention is not applied to crucibles of limited surface area where more often than not the metal is in circulation, but to furnaces where the bath is stationary and occupies a surface area at least equal to 10 sq.m.

These furnaces are generally closed at the top and their roof is provided with suitable apertures through which the assemblies are introduces. These are suspended from a removable portico: a kind of metal frame which, by various mechanical means (pulleys, wheels, jacks, etc.), makes it possible to move them horizontally from a waiting position to a position above the apertures and to lower them simultaneously into the bath and to withdraw them after the metal has been treated. Each of the assemblies is connected to a motor intended to rotate the injector and it communicates with gas inlets via flexible tubes. The movements of the portico, the speed of rotation of the motors and the adjustment of the rates of gas flow are controlled from a control station which simultaneously manages the entire furnace operating line.

These assemblies are partly immersed in the bath and the immersed parts are separated from one another solely by the bath, that is to say there is no solid partition forming a screen between them.

Under these conditions, and in order to avoid any interference between the actions of each of them, it was likewise necessary to invest in the assemblies characteristic features which are special both as regards their reciprocal positioning and their individual structure.

From the point of view of position, the assemblies have their axes situated, two by two, in different planes in order to arrive at an offset and in order to avoid any alignment of more than two assemblies. The results of tests conducted with and without an offset demonstrate that the liquid-gas exchange is better in an offset position.

From the structure point of view, it has been found that the efficiency of the treatment was likewise enhanced in the absence of any vortex, a phenomenon which is translated by an entrainment and a lowering of the level of the bath in contact with each assembly and which is generally attenuated by the introduction of baffles into the bath. As this solution was impossible in a furnace, the Applicants have sought and found that by enclosing the rotor in a stator it was possible to achieve the same result.

Thus, gas injectors consist of a rotary shaft connected at its top end to a driving motor and at its bottom end to a rotor, a kind of disc provided with blades on its lateral wall. The shaft is pierced along its axis by a cavity which opens out onto its wall above the furnace and which is closed at the bottom and connected to passages which pass through the blades to open out into the bath on its face which is not adjacent to the rotor. This cavity and these passages serve to distribute the gas throughout the bath.

These shafts are enclosed at a short distance by the stator which extends upwardly beyond the furnace where it is fixed and towards the bottom to a point close to the upper surface of the rotor where it forms a relatively narrow space of a few millimeters so that the layer of metal present there acts as a hydrodynamic bearing for the rotor and facilitates rotation of the latter.

Furthermore, the lateral space separating the stator from the rotor is filled with metal during the treatment and acts as a shock absorber so that any "whiplash" effect of the rotor axis and any risk of breakage are set aside. Preferably, this space measures between 10 and 30 mm.

Without its being vital to implementation of the invention but in order to improve its possibilities, it is preferable for the injectors all to rotate in the same direction in order to avoid eddying which might interfere with the impurities rising to the surface.

With identical rotors, as is more usually the case, it is preferable to place the axes at equal distances from one another. These distances may vary between 2 and 6 times the diameter of the rotors, which is generally between 100 and 500 mm so that they stay within a range which ensures both a suitable dimension in order not excessively to multiply the number of injectors and which is compatible with the mechanical strength of the shafts.

Furthermore, the range of rotary speeds which make it possible to obtaim satisfactory dispersion without resorting to excessive rotary torques is between 150 and 600 r.p.m.

With regard to the rate of gas flow, this is preferably between 6 and 12 cu.m/h per injector, a lesser rate of flow uselessly prolonging the duration of the treatment and a greater flow resulting in the formation of excessively large bubbles which come to the surface of the bath without having reacted. This gas is preferably distributed by four blades situated in planes which form an angle comprised between 3 and 30 degrees in relation to the vertical, distributed symmetrically about the rotor and provided horizontally through their entire width with a passage having a diameter of 1 to 3 mm approx. and connected at one end to the cavity in the shaft and which has the other end discharging at the end of the blade.

So that the height of the bath traversed by the gas bubbles is sufficient to achieve suitable efficacy, the rotor is preferably disposed at a distance from the bottom of the furnace of between one-quarter and one-half the height of the bath.

For optimum fulfilment of the hydrodynamic bearing function, the stator is preferably extended to a distance of between 10 and 50 mm from the upper surface of the rotor.

Under these conditions, the apparatus according to the invention has the following advantages:

very low atmospheric pollution and therefore an improvement in the working conditions for the staff an improvement in the metallurgical quality of the metal due to greater efficiency of the treatment a reduction in the treatment time a reduction in the condumption of gas a reduction in the loss of metal an increase in the productivity of the furnaces and good mechanical strength in the assemblies.

Figure 2:
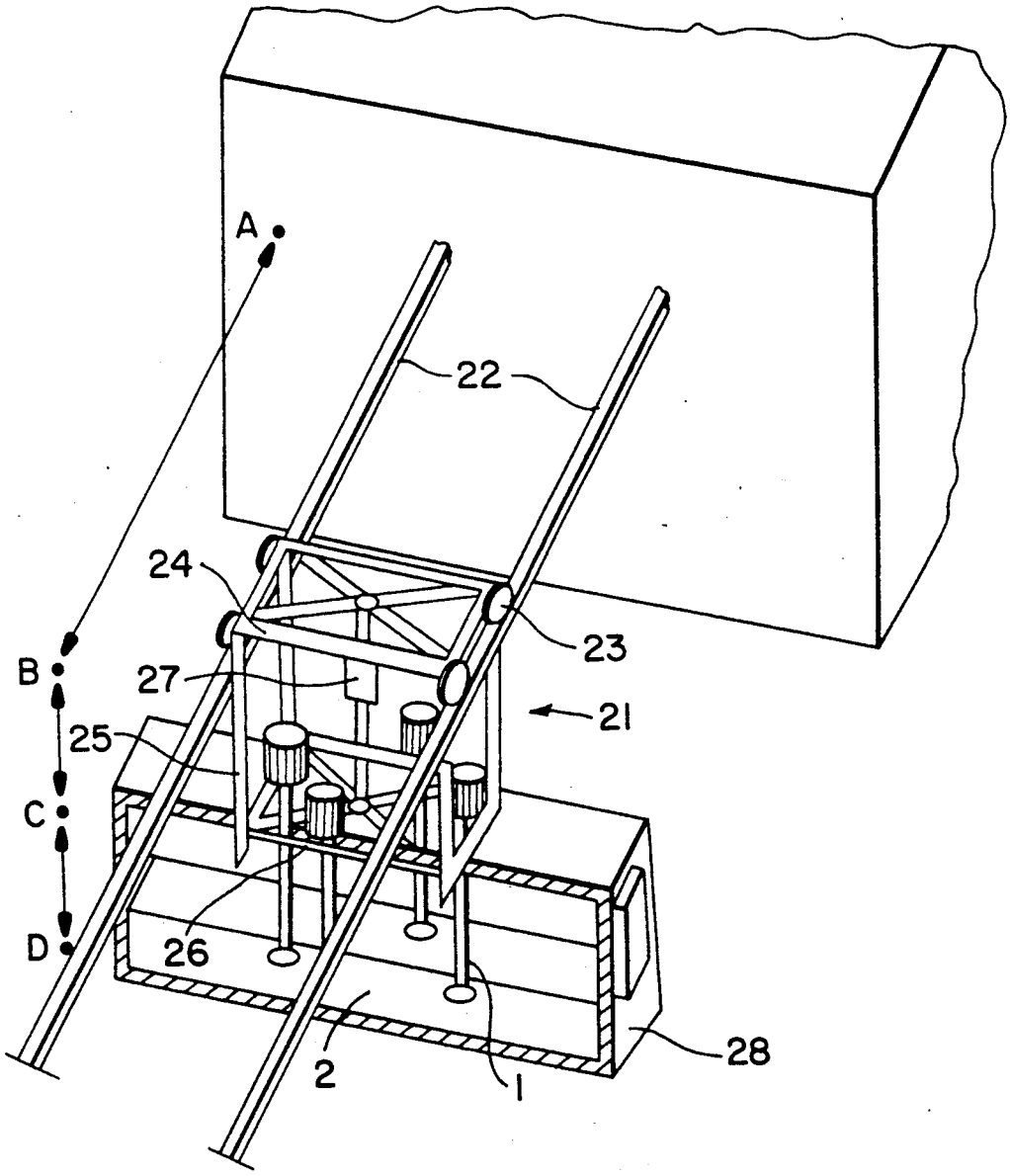

The invention will be more clearly understood from the attached drawings in which:

FIG. 1 is a vertical sectional view through a gas injector assembly positioned on a furnace, and FIG. 2 shows in perspective a removable portico from which are suspended four gas injector assemblies which are immersed in the furnace which is shown in vertical section.

More precisely in FIG. 1 there is shown a gas injector assembly 1 which is partly immersed in the bath 2 through an aperture 3 provided in the roof 4 of the furnace. This assembly comprises a rotary shaft 5 through the axis of which extends a cavity 6 opening out below the furnace at 7 through which the gas is supplied as indicated by 8. The shaft 5 is provided at the bottom with a rotor 9 fitted with blades 10 each of which is provided at its end with a passage 11 connected to the cavity 6 and which injects the gas into the subsequent bath 12. The shaft 5 is enclosed by a stator 13 in such a way that it leaves a space 14 into which the bath can penetrate. This stator extends downwardly to a short distance from the upper surface of the rotor to allow the bath to form an annular zone 15 which acts as a hydrodynamic bearing; towards the top, the stator passes through the roof of the furnace from which it is suspended by a collar 16. The motor 17 rotates the rotor through the shaft.

FIG. 2 shows a portico 21 which rests on rails 22 through four wheels 23. This portico consists of an upper frame 24 to which the wheel axles are fixed, four vertical members 25 and the bottom frame 26 which can be moved along the upright members by means of a jack 27. Suspended from this bottom frame are the four gas injector assemblies 1 which are immersed in the bath of metal 2 to be treated which is contained in the furnace 28 according to positions which are staggered in respect of one another.

In operation, when the portico is in the waiting position A and the bottom frame is in the high position, it is brought to position B situated above the furnace and then the bottom frame is lowered to the intermediate position C where the elements are preheated before reaching the position D at which the elements are immersed in the bath. At this moment, the motors of the injectors are started and the gas is delivered to the blades.

After treatment, the bottom frame is raised progressively in such a way as to cause the bath to flow into the rotor-stator gap. When the frame reaches the high position B it is then returned to position A.

The invention can be illustrated by means of the following example of application.

In a holding furnace containing 35 tonnes Al 5182 according to the Aluminium Association Standards, forming a bath with a surface area of 30 sq.m, 0.6 m deep and with a free surface area 1.60 m from the roof, there are immersed four gas dispersing elements disposed in a square measuring 3×3 m.

The details of these elements were as follows:

shaft length: 2.625 m rotor diameter: 0.25 m blade angle: 4° diameter of passages: 0.0025 m lateral space between rotor and stator: 0.016 m vertical space between rotor and stator: 0.05 m.

The working conditions were as follows:

distance from the bottom of the rotors to the bottom of the furnace: 0.20 m speed of rotation: 260r.p.m.

gas used: 95% by volume argon and 5% chlorine rate of gas flow: 10 cu.m/h per injector quantity of chlorine introduced: 0.06 kg/tonne duration: 20 mins.

A sample of metal treated in this way was subjected to the telegaz analysis method to determine its hydrogen content. The quantity found was equal to 0.10 μg/g metal.

For comparison, a bath identical to the former, treated with a quantity of hexachloroethane corresponding to 2 kg $Cl_2$ for 120 mins. resulted in a hydrogen content of 0.35 μg/g whereas, when using injection rods, it was necessary to take 60 mins. and use 1.5 kg $Cl_2$ in order to obtain a hydrogen content equal to 0.2 μg/g.

The considerable progress achieved by the invention with reference to treatment time, quantity of chlorine used and the quality of the metal obtained will be readily appreciated.

We claim:

1. Apparatus for gas teatment of a bath of liquid aluminium at rest in a furnace having a roof and in which the bath has a surface area of at least 10 $m^2$, comprising:

a removable gantry disposed above the furnace; and at least three gas injection assemblies suspended from said gantry and passing through the roof into the furnace for partial immersion in the bath, each assembly being more than 2 m long and comprising a rotary shaft having a cavity passing therethrough from top to bottom along a longitudinal axis thereof, and a rotor joined to the bottom of said shaft and having an upper surface and a plurality of laterally extending blades, each said blade having a laterally extending passage in communication with said cavity, means located above said furnace for connecting said cavity to a source of treating gas, means located above said furnace for rotating said shaft, and stator means enclosing said shaft, said stator means extending from a point above the roof downwardly to a point close to the upper surface of the rotor, thereby providing a space between the rotor and the stator which is adapted to be filled with the bath and serves as a shock obsorber, wherein no more than two of said assemblies are disposed in the same vertical plane, and the immersed portions of the assemblies are separated from each other solely by the bath.

2. An apparatus according to claim 1, wherein said means for rotating is adapted to rotate all shafts in the same direction.

3. An apparatus according to claim 1, the axes of the shafts are equidistant from one another.

4. an apparatus according to claim 1, wherein the axes are separated from one another by a distance comprised between two and six times the diameter of the rotors.

5. An apparatus according to claim 1, wherein the rotors have a diameter between 100 and 500 mm.

6. An apparatus according to claim 1, wherein said means for rotating is adapted for rotating the rotors at a speed between 150 and 600 r.p.m.

7. An apparatus according to claim 1, comprising means for providing a flow of treating gas at a rate of between 6 and 12 cu.m/h per injector.

8. An apparatus according to claim 1, wherein the blades are situated in planes which form with the vertical an angle of between 3 and 10 degrees.

9. An apparatus according to claim 1, wherein the rotor is disposed at a distance from the bottom of the furnace which is between one-quarter and one-half the height of the bath.

10. An apparatus according to claim 1, wherein the bottom of the stator is at a distance of between 10 and 50 mm from the upper surface of the rotor.

11. An apparatus according to claim 1, wherein the lateral space between the rotor and the stator is between 10 and 30 mm.

* * * * *